US006082149A

United States Patent [19]

Woods

[11] Patent Number: 6,082,149

[45] Date of Patent: Jul. 4, 2000

[54] CHEMICAL WASHING SYSTEM INCLUDING A CHEMICAL DISPENSING SYSTEM AND SUITABLE FOR USE WITHIN A SEMICONDUCTOR FABRICATION CLEAN ROOM

[75] Inventor: Robert L. Woods, Johnson City, Tex.

[73] Assignee: Advanced Micro Devices, Inc., Sunnyvale, Calif.

[21] Appl. No.: 09/167,120

[22] Filed: Oct. 6, 1998

[51] Int. Cl.[7] ..... D06F 33/04

[52] U.S. Cl. ..... 68/17 R; 68/207; 68/210; 454/187

[58] Field of Search ..... 68/17 R, 207, 68/23.5, 210; 454/187

[56] References Cited

U.S. PATENT DOCUMENTS

| | | | |
|---|---|---|---|
| 2,879,143 | 3/1959 | Thurman | 68/17 R |
| 3,044,285 | 7/1962 | Koplin | 68/17 R |
| 3,318,122 | 5/1967 | Starr et al. | 68/17 R |
| 3,577,752 | 5/1971 | Hertig . | |
| 3,597,943 | 8/1971 | Gayring . | |
| 3,771,333 | 11/1973 | Jurjans | 68/17 R |
| 3,804,297 | 4/1974 | Jurjans | 68/17 R |
| 3,826,113 | 7/1974 | Boraas et al. | 68/207 |
| 3,891,123 | 6/1975 | Blackburn | 68/207 |
| 4,561,268 | 12/1985 | Southwick et al. . | |
| 5,014,211 | 5/1991 | Turner et al. | 68/17 R |
| 5,099,751 | 3/1992 | Newman et al. . | |
| 5,208,930 | 5/1993 | Chabard | 68/17 R |
| 5,435,157 | 7/1995 | Laughlin | 68/17 R |

OTHER PUBLICATIONS

Washtex MCR Microcontamination (Clean Room) Laundry System product brochure from Washtex Machinery Company, a Division of White Consolidated Industries, Wichita Falls, Texas, published Jan. 1993, 12 pages.

*Primary Examiner*—Frankie L. Stinson

*Attorney, Agent, or Firm*—Kevin L. Daffer; Conley, Rose & Tayon

[57] ABSTRACT

A chemical washing system is presented including a chemical dispensing system. The chemical dispensing system includes a container for storing a liquid chemical, a dispensing unit coupled to the container for dispensing the liquid chemical, and a conduit for conveying the liquid chemical from the dispensing unit to a receptacle of a machine which uses the liquid chemical during normal operation. The container, the dispensing unit, and the receptacle may be enclosed within one or more service areas separate from a "user interface area" containing a portion of the machine with which a user interfaces during normal operation. In order to prevent airborne particulates and other contaminants within the one or more service areas from entering the user interface area, a positive air pressure differential is maintained between the user interface area and the one or more service areas. The chemical washing system includes a textile laundering appliance (e.g., a washing machine) having two opposed sides: a loading side for loading textiles into the washing machine and an unloading side for unloading textiles from the washing machine. The washing machine may be located within the clean room, and may be used to launder clean room garments. The chemical dispensing system delivers a liquid chemical (e.g., detergent) to the washing machine. The washing machine may be a washer/extractor including a manual dispensing port which functions as the receptacle.

19 Claims, 4 Drawing Sheets

CHEMICAL WASHING SYSTEM INCLUDING A CHEMICAL DISPENSING SYSTEM AND SUITABLE FOR USE WITHIN A SEMICONDUCTOR FABRICATION CLEAN ROOM

BACKGROUND OF THE INVENTION

1. Field of the Invention

This invention relates to chemical delivery systems, and more specifically to a chemical delivery system for delivering a liquid chemical to a textile laundering appliance (e.g., a washing machine) located within a semiconductor fabrication clean room.

2. Description of Related Art

It is well known that small particles (i.e., particulates) can cause defects in integrated circuits formed upon semiconductor wafers. Such defects may prevent the integrated circuits from performing their intended functions. For example, a process called photolithography is used to pattern layers of desired materials deposited upon the semiconductor wafers. During photolithography, light passing through a pattern on a mask transfers the pattern to a layer of light-sensitive photoresist deposited over a layer of desired material. Particulates on the surface of the mask or on the surface of the photoresist layer which block or diffuse the light cause imperfect pattern registrations (i.e., imperfect feature formations). The resulting imperfect features formed within an integrated circuit may render the integrated circuit inoperable.

In order to help keep wafer processing areas as particle free (i.e., "clean") as possible, such areas are designated as "clean rooms". Particulates may be present within the air in clean rooms, introduced by processing personnel, suspended in liquids and gasses used during wafer processing, and generated by processing equipment located within the clean rooms. As a result, the air within clean rooms is typically continuously filtered. Liquids and gasses entering clean rooms and used during processing are also filtered, and clean rooms typically exclude portions of processing equipment which generate particulates.

Air "cleanliness" levels of clean rooms are determined by the densities of different sizes of particulates present in the air and are specified using class numbers. The allowable densities of particulates within clean rooms is dependent upon the clean room class numbers and the largest dimensions of the particulates. For example, a class 1 clean room can have only 1 particle with a largest dimension of 0.5 micron in each cubic foot of air, but may have up to 34 particles with largest dimensions of 0.1 micron per cubic foot of air. The required class number for a particular clean room is largely determined by the feature sizes of the integrated circuit devices being produced within the clean room. Portions of many integrated circuits produced today are formed within class 1 clean rooms.

Humans continuously generate large numbers of particulates including dead skin cells and hairs. When working in clean rooms, personnel typically wear low-particle-generating coverings which almost completely envelope their bodies. The clean room garments essentially form filters around the wearers, reducing the number of particulates generated by the wearers which escape into the air. Exemplary garments include overalls and hoods, face masks, safety glasses or goggles, leggings, shoe covers, and gloves. Undergarments such as caps or nets may also be used to keep hair in place under hoods.

Clean room garments must be laundered on a regular basis if they are to remain functional and sanitary. The laundering process must, however, be carried out such that the clean room garments do not become sources of large number of particulates. For example, particles present in the water used to wash the clean room garments, or particles of a laundering agent (e.g., a detergent) added to the water, may become trapped in fibers of the clean room garments during laundering. Such particles may be released into the air during wear of the garments. Improper laundering may also damage the fibers of the clean room garments, causing them to break apart. In this case, small pieces of the fibers may be released into the air during wear.

No matter how carefully the laundering process is carried out, transport of laundered clean room garments through the relatively "dirty" environment between an off-site facility and the clean room presents a particle contamination problem. In fact, the plastic bags routinely used to protect laundered garments are themselves particle generators, rendering them ineffective in protecting clean room garments from the introduction of particles during transit. It would thus be desirable to launder clean room garments in a laundry facility adjacent to or within a clean room facility.

FIG. 1 is a front elevation view of an exemplary washer/extractor 10 for laundering textiles. Washer/extractor 10 may be installed in a laundry facility adjacent to or within a clean room facility. Washer/extractor 10 includes a cylindrical drum mounted within a housing 12 such that a rotation axis of the drum is horizontal. Housing 12 is typically bolted to a floor 15. In order to provide physical isolation for laundered and soiled garments, washer/extractor 10 has a loading side on one side of the drum and an unloading side on the other side of the drum. Soiled garments are loaded into the drum from the loading side and removed from the drum using the unloading side.

During a typical wash operation, soiled garments are placed within the drum, the drum is filled to a certain level with water, detergent is added to the water in the drum, and the drum is rotated about the horizontal axis in order to flush foreign substances from the garments. During a typical extraction operation, the drum is rotated about the horizontal axis at a relatively high rate of speed. Centrifugal force acting radially upon the water retained by the textiles causes the water to leave the textiles and exit the drum through openings (e.g., perforations) in an outer surface of the drum. Six ports 14 are provided on the loading side of washer/extractor 10 for adding liquid chemicals (e.g., detergent) to water in the drum.

A problem arises when washer/extractor 10 is located within a clean room and ports 14 are used to add a liquid chemical (e.g., detergent) to the drum. Any spillage of the liquid chemical adjacent to the loading (or unloading) side constitutes an introduction of contaminants into the clean room. It would thus be desirable to have a chemical washing system including a textile laundering appliance and a chemical dispensing system, wherein the chemical dispensing system delivers a liquid chemical (e.g., detergent) to a textile laundering appliance. The desired textile laundering appliance has opposed loading and unloading sides, and is located within a clean room. The desired chemical dispensing system delivers the liquid chemical to a portion of the textile laundering appliance remote from the loading and unloading sides. Such a chemical dispensing system would reduce the impact of a chemical spill upon clean room operations.

SUMMARY OF THE INVENTION

The problems outlined above are in large part solved by a chemical washing system including a chemical dispensing system. The chemical dispensing system is suitable for delivering a liquid chemical to a textile laundering appliance located within a semiconductor fabrication clean room. The chemical dispensing system includes a container for storing a liquid chemical, a dispensing unit coupled to the container for dispensing the liquid chemical, and a conduit extending between the dispensing unit and a receptacle of a machine which uses the liquid chemical during normal operation. The conduit is used to convey the liquid chemical from the dispensing unit to the receptacle. The container, the dispensing unit, and the receptacle may be enclosed within one or more service areas separate from a "user interface area" containing a portion of the machine with which a user interfaces during normal operation.

The chemical washing system includes a textile laundering appliance (e.g., a washing machine) having two opposed sides: a loading side for loading textiles into the washing machine and an unloading side for unloading textiles from the washing machine. The washing machine may be located within the clean room, and may be used to launder clean room garments. The chemical dispensing system delivers a liquid chemical to the washing machine. The liquid chemical may be a detergent used by the washing machine during a wash operation. The washing machine may be a washer/extractor including a manual dispensing port which functions as the receptacle. The portion of the washing machine with which the user interfaces during normal operation may include the loading and unloading sides of the washing machine.

In order to prevent airborne particulates and other contaminants within the one or more service areas from entering the user interface area, a positive air pressure differential is maintained between the user interface area and the one or more service areas. An access door may be positioned in an opening between the one or more service areas and the user interface area. When the access door is opened, air flows from the user interface area into the one or more service areas.

The dispensing unit is coupled to the machine (e.g., washing machine) by a signal line and the conduit. The signal line may include a wire for conveying an electrical signal or a tube for conveying a pressure signal (e.g., pneumatic or hydraulic). When the machine requires the liquid chemical, the machine asserts a control signal upon the signal line. For example, the machine may be a washing machine which asserts the control signal during a wash operation. The dispensing unit receives the signal and delivers the liquid chemical under pressure to the machine via the conduit. The dispensing unit may include, for example, a pump for pressurizing the liquid chemical. Upon receiving the control signal, the dispensing unit may deliver a predetermined amount of the liquid chemical, or may continue to deliver the liquid chemical as long as the control signal is asserted.

In one embodiment, the conduit may include a continuous length of flexible-walled tube extending between the dispensing unit and the machine receptacle. Alternately, the conduit may include a substantially rigid center portion coupled between a first flexible-walled tube portion connected to the dispensing unit and a second flexible-walled tube portion connected to the receptacle. Further, the conduit may include a continuous flexible-walled tube extending between the container and the receptacle and passing uninterrupted through the dispensing unit. The dispensing unit may include a peristaltic pump having multiple spaced rollers in contact with an outer surface of the flexible-walled tube. When the pump is activated, the rollers may roll across the outer surface of the flexible-walled tube in succession, alternately pinching and releasing the flexible-walled tube so as to create a pumping action which pressurizes the liquid chemical within a portion of the flexible-walled tube between an output side of the pump and the receptacle. In this case the peristaltic pump may advantageously be removed for maintenance or repair/replacement without forming an opening in the conduit through which the liquid chemical may escape.

BRIEF DESCRIPTION OF THE DRAWINGS

Other objects and advantages of the invention will become apparent upon reading the following detailed description and upon reference to the accompanying drawings in which.

Figure 1:
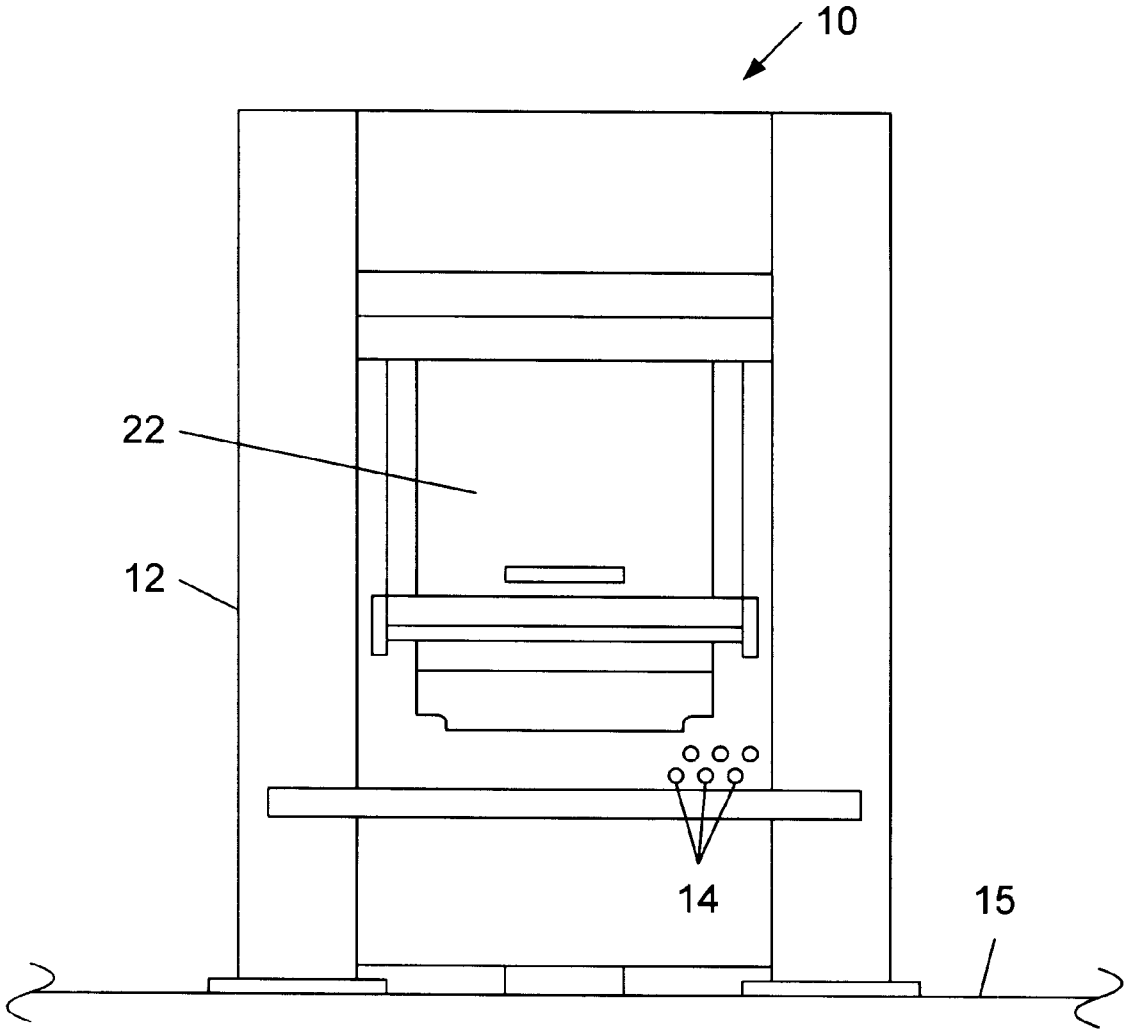
Fig. 1 (Prior Art)
FIG. 1 is a front elevation view of an exemplary washer/extractor for laundering textiles.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Figure 2:
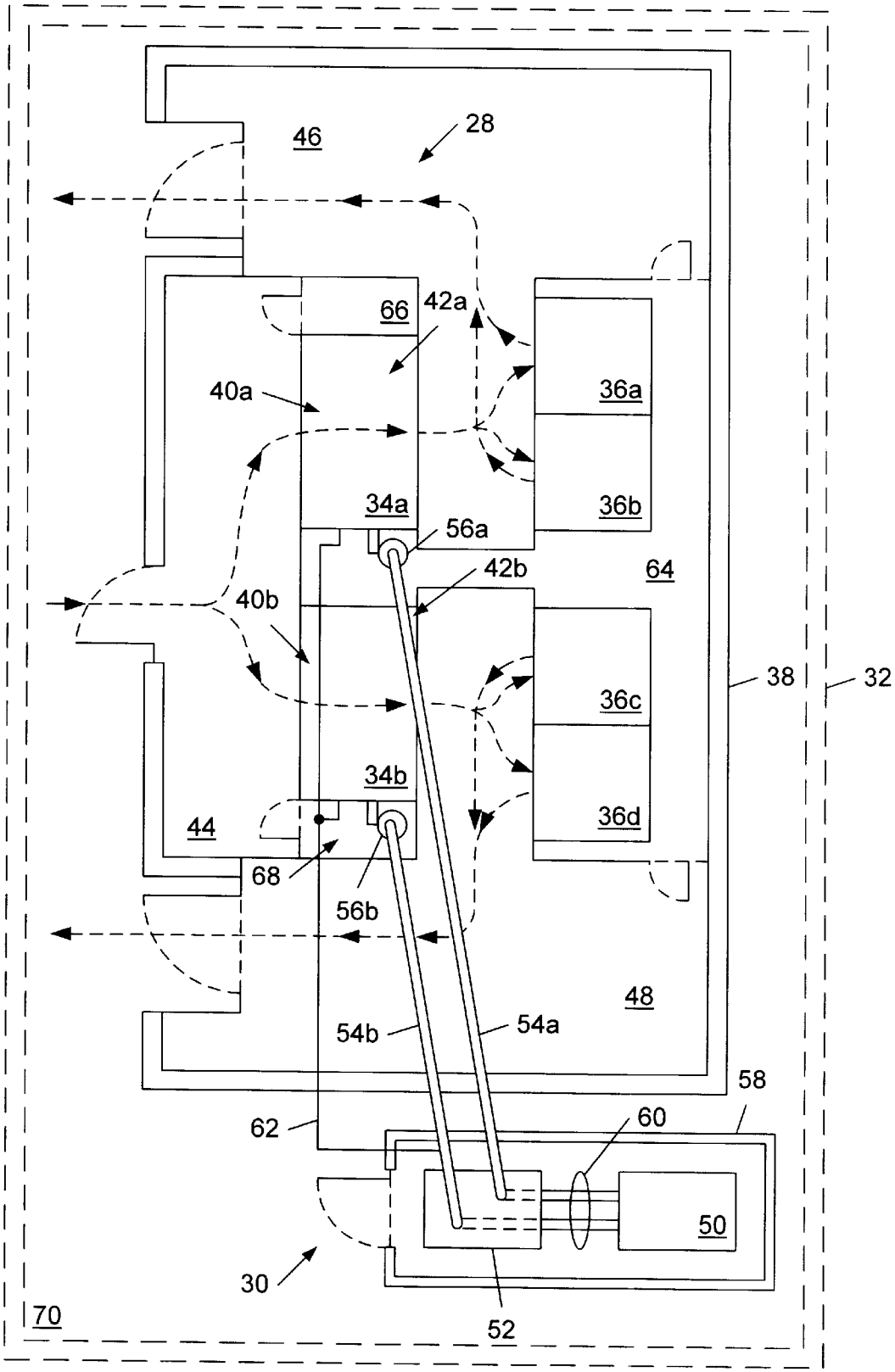
FIG. 2 is a top plan view of one embodiment of a chemical washing system including a chemical dispensing system and two washing machines, wherein the chemical dispensing system delivers a liquid chemical (e.g., detergent) to the two washing machines, and wherein each washing machine has a receptacle for receiving the liquid chemical.

FIG. 2 is a top plan view of one embodiment of a chemical washing system 28 including a chemical dispensing system 30 and two washing machines 34*a–b*. Chemical dispensing system 30 is located within a clean room 32, and supplies a liquid chemical (e.g., detergent) to washing machines 34*a–b*. Washing machines 34*a–b* use water to launder textiles, and may be used to launder clean room garments worn by personnel working within clean room 32. Each washing machine 34 may be a washer/extractor 10 described above. Four dryers 36*a–d* may be used to substantially remove water remaining in the textiles after the textiles have been subjected to a wash operation within washing machines 34*a–b*. Washing machines 34*a–b* and dryers 36*a–d* are located in a laundry room 38 within clean room 32.

Washing machine 34*a* has a loading side 40*a* for loading textiles into washing machine 34*a* and an opposed unloading side 42*a* for unloading textiles from washing machine 34*a*. Washing machine 34*a* is positioned within a sealed opening in a wall separating a first laundering area 44 from a second laundering area 46. Loading side 40*a* of washing machine 34*a* is located within first laundering area 44, and unloading side 42*a* of washing machine 34*a* is located within second laundering area 46. Similarly, washing machine 34*b* has a loading side 40*b* located within first laundering area 44 and an unloading side 42*b* located within a third laundering area 48, and is positioned within a sealed opening in a wall separating first laundering area 44 from third laundering area 48. As a result, a significant amount of physical separation is achieved between soiled textiles (e.g., garments) in laundering area 44 and laundered textiles in laundering areas 46 and 48. Laundering areas 46 and 48 may have different "cleanliness" levels. For example, laundering area 46 may be a class 10 clean room area, and laundering area 48 may be a class 1 clean room area.

During the wash operation, the textiles may be loaded into a drum of one of the washing machines 34, the drum may be filled to a certain level with water, detergent may be added to the water in the drum, and the drum may be rotated about an axis which extends longitudinally through the drum (e.g., horizontally) in order to flush foreign substances from the garments. The adding of the detergent to the drum may be performed automatically by chemical dispensing system 30.

Chemical dispensing system 30 includes a container 50 for storing a liquid chemical, a dispensing unit 52 coupled to container 50 for dispensing the liquid chemical, and two conduits 54*a–b* for conveying the liquid chemical from dispensing unit 52 to receptacles 56*a–b* of respective washing machines 34*a–b*. Receptacles 56 may be manual dispensing ports for manual addition of liquid or dry chemicals (e.g., detergent) to water in the drum. The liquid chemical may be, for example, the detergent used by washing machines 34*a–b* during wash operations.

In the embodiment of FIG. 2, container 50 and dispensing unit 52 are located within a service room 58. Conduits 54*a–b* extend from dispensing unit 52 in service room 58 to washing machine 34*a–b* in laundry room 38. Container 50 may be any container suitable for storing the liquid chemical (e.g., a metal or plastic drum). One or more conduits 60 (e.g., flexible-walled tubes) coupled between container 50 and dispensing unit 52 convey the liquid chemical stored in container 50 to dispensing unit 52. As will be described below, conduits 54*a–b* may extend between container 50 and respective receptacles 56*a–b,* passing uninterrupted through dispensing unit 52. In this embodiment, conduits 60 are portions of conduits 54*a–b*.

Dispensing unit 52 is coupled to washing machines 34*a–b* by a signal bus 62 in addition to conduits 54*a–b*. Signal bus 62 includes one or more signal lines, wherein each signal line may be a wire for conveying an electrical signal or a tube for conveying a pressure signal (e.g., pneumatic or hydraulic). When washing machine 34*a* requires the liquid chemical (e.g., during the wash operation), washing machine 34*a* may, for example, assert a first control signal upon a first signal line of signal bus 62. Dispensing unit 52 receives the first control signal and delivers the liquid chemical under pressure to washing machine 34*a* via conduit 54*a*. Similarly, when washing machine 34*b* requires the liquid chemical, washing machine 34*b* may assert a second control signal upon a second signal line of signal bus 62. Dispensing unit 52 receives the second control signal and delivers the liquid chemical under pressure to washing machine 34*b* via conduit 54*b*. Dispensing unit 52 may include a pump for pressurizing the liquid chemical. Upon receiving the first or second control signal, dispensing unit 52 may deliver a predetermined amount of the liquid chemical, or may continue to deliver the liquid chemical as long as the control signal is asserted.

In one embodiment, conduits 54*a–b* may be a continuous flexible-walled tubes extending between container 50 and respective receptacles 56*a–b* and passing uninterrupted through dispensing unit 52. Dispensing unit 52 may include a pair of peristaltic pumps, each pump having multiple spaced rollers in contact with an outer surface of a corresponding conduit 54. When one of the pumps is activated, the rollers may roll across the outer surface of the corresponding conduit 54 in succession, alternately pinching and releasing the flexible-walled tube so as to create a pumping action which pressurizes the liquid chemical within a portion of the conduit 54 between an output side of the pump and the respective receptacle 56. In this case the peristaltic pumps may advantageously be removed for maintenance or repair/replacement without forming an opening in conduit 54 through which the liquid chemical may escape.

A side of washing machine 34*a* to which receptacle 56*a* is attached is enclosed within a service chase 64. An opposite side of washing machine 34*a* is enclosed within a service chase 66. Both of the sides of washing machine 34*a* enclosed by service chases 64 and 66 have service access panels which allow access to mechanical and/or electrical components of washing machine 34*a* for maintenance and repair, and are not portions of washing machine 34*a* with which a user interfaces during normal operation. On the other hand, the user does interface with loading side 40*a,* within first laundering area 44, and unloading side 42*a,* within second laundering area 46, during normal operation.

Similarly, a side of washing machine 34*ba* to which receptacle 56*b* is attached is enclosed within a service chase 68. An opposite side of washing machine 34*b* is enclosed within service chase 64. Both of the sides of washing machine 34*b* enclosed by service chases 64 and 68 have service access panels which allow access to mechanical and/or electrical components of washing machine 34*a* for maintenance and repair, and are not portions of washing machine 34*b* with which a user interfaces during normal operation. On the other hand, the user does interface with loading side 40*b,* within first laundering area 44, and unloading side 42*b,* within third laundering area 48, during normal operation.

In order to prevent airborne particulates and other contaminants within service room 58 from entering a clean area 70 within clean room 38, a positive air pressure differential is maintained between clean area 70 and service room 58. A first access door is positioned in an opening between service room 58 and clean area 70. When the first access door is opened, air flows from the clean area 70 into service room 58.

Similarly, in order to prevent particulates and other contaminants within service chase 64 from entering adjacent second laundering area 46 or adjacent third laundering area 48, a positive air pressure differential is maintained between second laundering area 46 and service chase 64, and between third laundering area 48 and service chase 64. A second access door is positioned in an opening between service chase 64 and second laundering area 46. When the second access door is opened, air flows from the second laundering area 46 into service chase 64. A third access door is positioned in an opening between service chase 64 and third laundering area 48. When the third access door is opened, air flows from the third laundering area 48 into service chase 64.

Further, a positive air pressure differential is maintained between first laundering area 44 and adjacent service chases 66 and 68 in order to prevent particulates and other contaminants within service chases 66 and 68 from entering first laundering area 44. A fourth access door is positioned in an opening between service chase 66 and first laundering area 44. When the fourth access door is opened, air flows from first laundering area 44 into service chase 66. A fifth access door is positioned in an opening between service chase 68 and first laundering area 44. When the fifth access door is opened, air flows from first laundering area 44 into service chase 68.

It is noted that in other embodiments, container 50 and dispensing unit 52 may be located within service chase 64, 66, or 68 within laundry room 38.

Each conduit 54*a* may be a single conduit or multiple separate conduits routed in parallel. Each conduit 54 may include a continuous length of flexible-walled tube extending between dispensing unit 52 and receptacle 56 of washing machine 34. Alternately, each conduit 54 may include a substantially rigid center portion coupled between a first flexible-walled tube portion connected to dispensing unit 52 and a second flexible-walled tube portion connected to receptacle 56.

Figure 3:
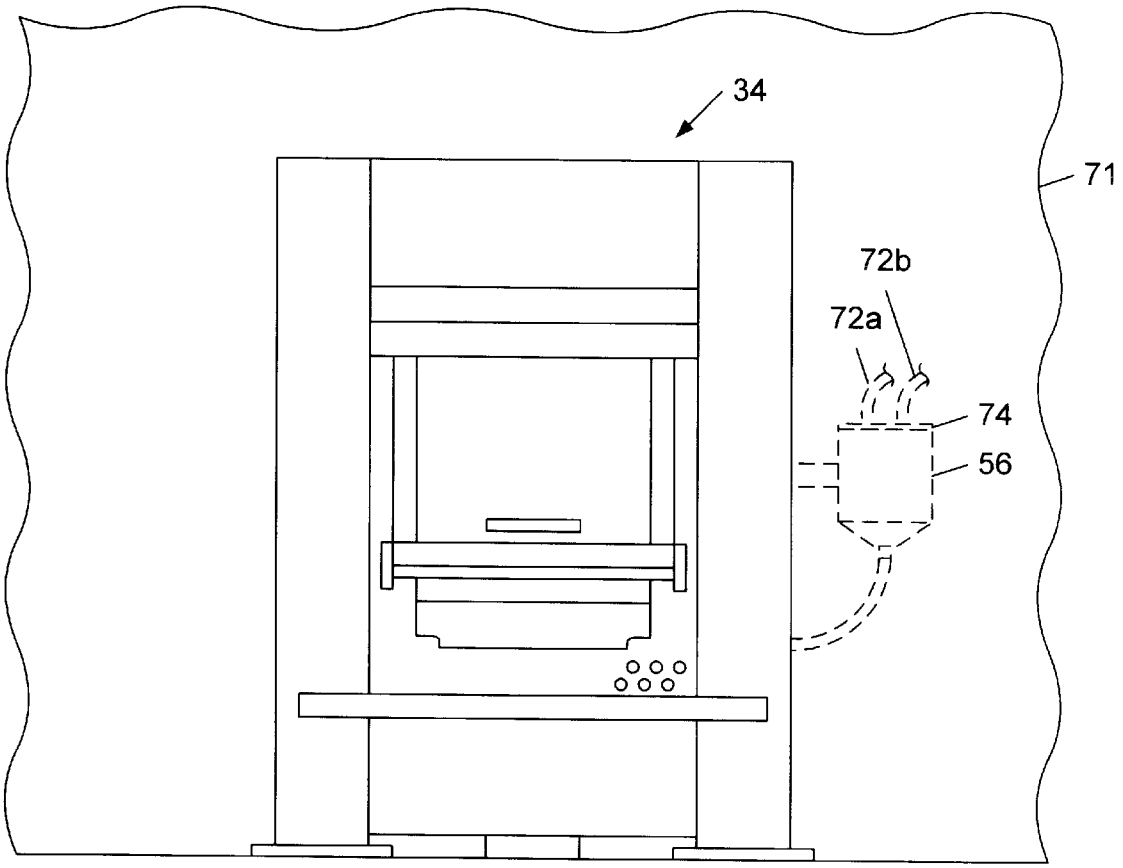
FIG. 3 is a front elevation view of an exemplary embodiment of the washing machine of FIG. 2, wherein the receptacle may be a manual dispensing port for manual addition of liquid or dry chemicals (e.g., detergent) to water in a drum of the washing machine.
Figure 4:
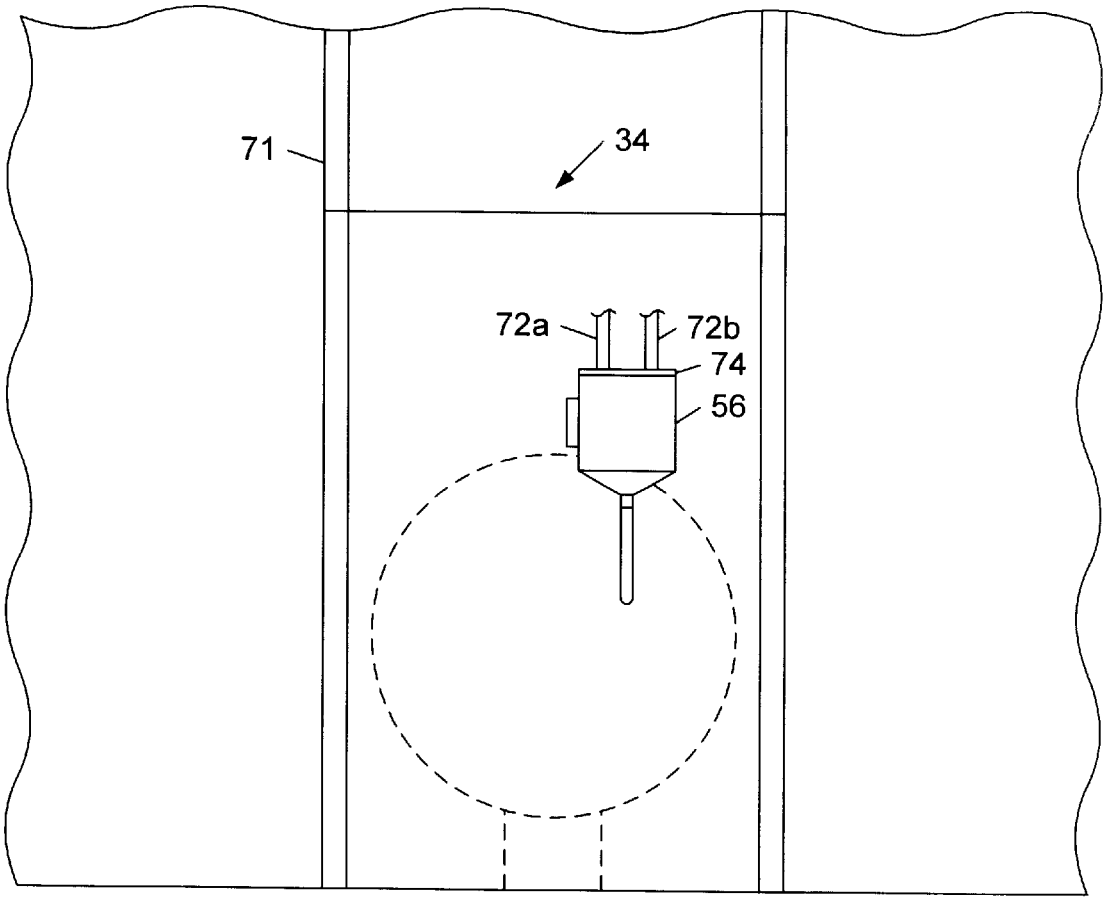
FIG. 4 is a side elevation view of the washing machine of FIG. 3 depicting a side of the washing machine to which the receptacle is attached.

FIG. 3 is a front elevation view of an exemplary embodiment of washing machine 34. Washing machine 34 may be washer/extractor 10 of FIG. 1. In FIG. 3, washing machine 34 is viewed from the loading side. Elements behind a wall 71 separating the loading side of washing machine 34 from a side with equipment access panels are depicted using dotted lines. Receptacle 56 may be a manual dispensing port for manual addition of liquid or dry chemicals (e.g., detergent) to water in the drum. FIG. 4 is a side elevation view of the exemplary embodiment of washing machine 34 of FIG. 3 depicting the side of washing machine 34 to which receptacle 56 is attached. In the embodiment of FIGS. 3 and 4, conduit 54 includes two separate flexible-walled tubes in parallel: a flexible-walled tube 72*a* and a flexible-walled tube 72*b*. Flexible-walled tubes 72*a–b* may be made of, for example, Teflon®, polyethylene, or polypropylene. Receptacle 56 includes a cover 74 with holes therethrough for receiving ends of flexible-walled tubes 72*a–b*. In order to allow visual inspection of the interiors of flexible-walled tubes 72*a–b* and receptacle 56, flexible-walled tubes 72*a–b* and cover 74 may be substantially transparent.

It is noted that in other embodiments, receptacle 56 may include a plumbing fitting for receiving an end of conduit 54.

It will be appreciated by those skilled in the art having the benefit of this disclosure that this invention is believed to be a chemical washing system including a chemical dispensing system and suitable for use within a semiconductor fabrication clean room. It is intended that the following claims be interpreted to embrace all such modifications and changes and, accordingly, the specification and drawings are to be regarded in an illustrative rather than a restrictive sense.

What is claimed is:

1. A chemical dispensing system, comprising:

a container for storing a liquid chemical;

a dispensing unit coupled to the container for dispensing the liquid chemical;

a conduit extending between the dispensing unit and a receptacle of a machine for conveying the liquid chemical from the dispensing unit to the receptacle; and wherein the container, the dispensing unit, and the receptacle are enclosed within at least one service area separate from a user interface area containing a portion of the machine with which a user interfaces during normal operation.

2. The chemical dispensing system as recited in claim 1, wherein a positive air pressure differential is maintained between the user interface area and the at least one service area.

3. The chemical dispensing system as recited in claim 1, wherein the machine is a washing machine for laundering textiles and having two opposed sides, and wherein one side is a loading side for loading textiles into the washing machine and the other side is an unloading side for unloading textiles from the washing machine, and wherein the loading and unloading sides comprise the portion of the machine with which a user interfaces during normal operation.

4. The chemical dispensing system as recited in claim 3, wherein the washing machine is a washer/extractor, and wherein the receptacle is a manual dispensing port.

5. The chemical dispensing system as recited in claim 3, wherein the washing machine is located within a clean room, and wherein the washing machine is used to launder clean room garments.

6. The chemical dispensing system as recited in claim 1, wherein an access door is positioned in an opening between the at least one service area and the user interface area, and wherein when the access door is opened, air flows from the user interface area into the at least one service area.

7. The chemical dispensing system as recited in claim 1, wherein the liquid chemical is a detergent.

8. The chemical dispensing system as recited in claim 1, wherein the conduit comprises a continuous flexible-walled tube extending between the container and the receptacle, wherein the conduit passes uninterrupted through the dispensing unit.

9. The chemical dispensing system as recited in claim 8, wherein the dispensing unit comprises a paristaltic pump for pressurizing the liquid chemical within the conduit.

10. The chemical dispensing system as recited in claim 8, wherein the continuous flexible-walled tube is substantially transparent.

11. The chemical dispensing system as recited in claim 1, wherein the conduit comprises a first flexible-walled tube portion coupled to the dispensing unit and a second flexible-walled tube portion coupled to the receptacle of the machine.

12. The chemical dispensing system as recited in claim 1, wherein the dispensing unit comprises a pump responsive to a control signal asserted by the machine.

13. The chemical dispensing system as recited in claim 12, wherein the machine asserts the control signal during a wash operation.

14. A washing system, comprising:

a first access door providing operable communication between a first user interface area and an interior portion of a washing machine;

a second access door providing operable communication between a second user interface area and the interior portion of the washing machine;

a conduit leading from a liquid detergent dispensing unit to a receptacle placed upon the washing machine in operable communication with water placed within the interior portion of the washing machine; and wherein the conduit, the dispensing unit, and the receptacle are enclosed within at least one service area separate from the first and second user interface areas.

15. The washing system as recited in claim 14, wherein the conduit comprises a flexible-walled tube.

16. The washing system as recited in claim 14, wherein the dispensing unit comprises a pump.

17. The washing system as recited in claim 14, wherein the pump is responsive to a control signal forwarded from the washing machine.

18. The washing system as recited in claim 14, wherein the second access door is within a clean room used to manufacture integrated circuits.

19. The washing system as recited in claim 18, further comprising an atmospheric pressure differential between the clean room and the at least one service area.

* * * * *